United States Patent [19]

Calkins

[11] Patent Number: 4,730,626

[45] Date of Patent: Mar. 15, 1988

[54] DRY BOWL SMOKER'S PIPE

[76] Inventor: Edward H. Calkins, P.O. Box 186, Gaylord, Mich. 49735

[21] Appl. No.: 843,971

[22] Filed: Mar. 25, 1986

Related U.S. Application Data

[63] Continuation-in-part of Ser. No. 331,316, Dec. 16, 1981, Pat. No. 4,577,645, which is a continuation of Ser. No. 213,725, Dec. 5, 1980, Pat. No. 4,362,169.

[51] Int. Cl.[4] ..... A24F 5/00; A24F 9/00

[52] U.S. Cl. ..... 131/196; 131/201; 131/210; 131/211; 131/212.2; 131/225; 131/226

[58] Field of Search ..... 131/225, 226, 227, 201, 131/211, 212.2, 210, 196

[56] References Cited

U.S. PATENT DOCUMENTS

| | | | |
|---|---|---|---|
| 2,269,541 | 1/1942 | MacDonald | 131/201 |
| 3,397,703 | 8/1968 | Otto | 131/201 |
| 3,774,624 | 11/1973 | Fassbender | 131/201 |

*Primary Examiner*—V. Millin

*Attorney, Agent, or Firm*—Larson & Taylor

[57] ABSTRACT

A smoker's pipe that includes a hollow shank, a bowl assembly mounted at one end of the shank and a bit connected to the other end of the shank. The pipe also comprises in one embodiment a flow separator which respectively directs the smoke and liquid components of the smoke fluid into a gaseous smoke conduit and a liquid conduit, part of each conduit being in the shank and part of each conduit being in the bit. Also included is a rotatable connector that sealingly connects the two parts of each conduit together, yet also permits relative rotation of the bit and shank.

10 Claims, 15 Drawing Figures

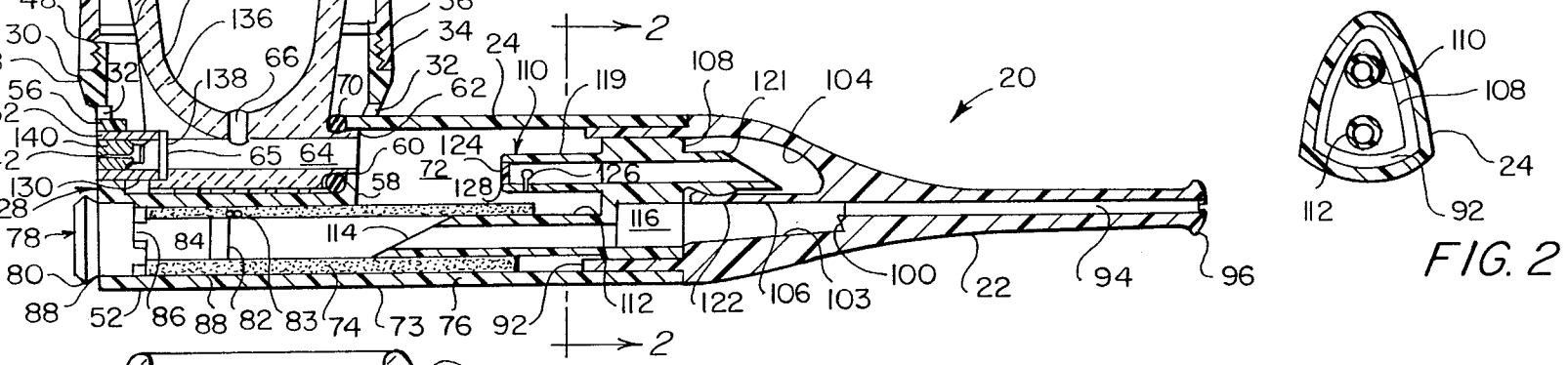
FIG. 1
FIG. 2
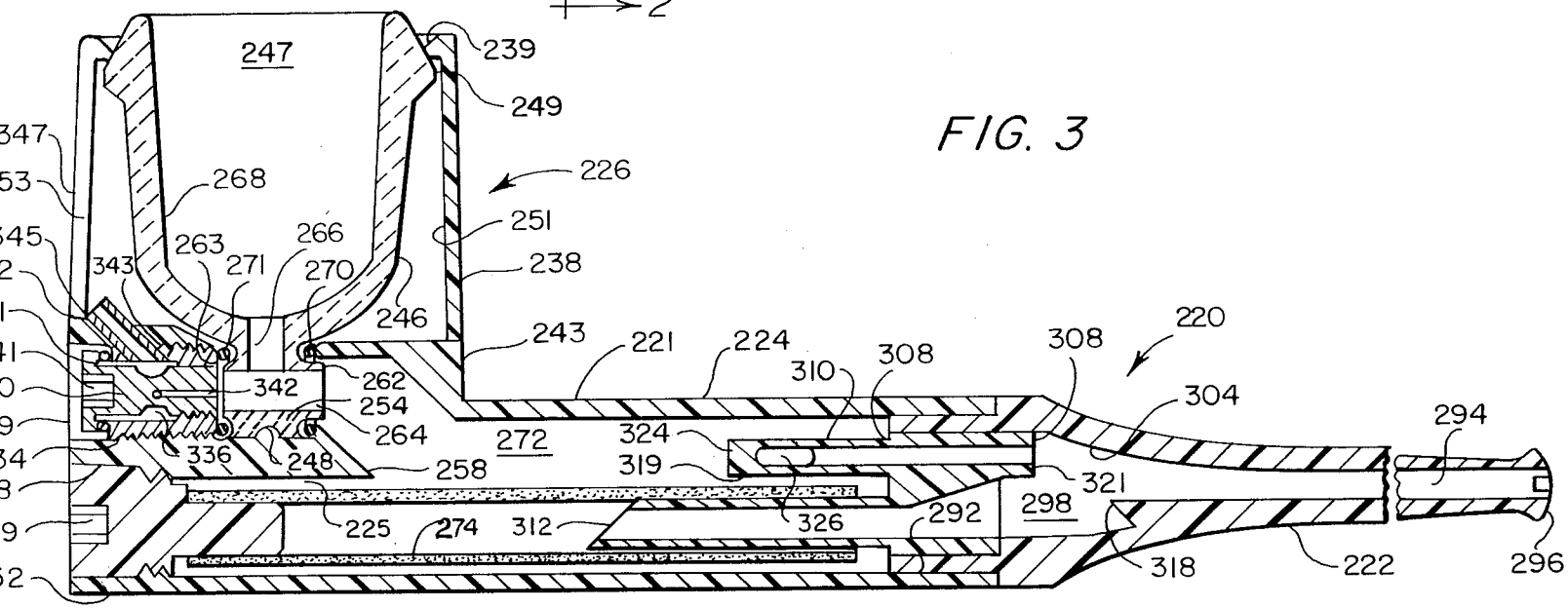
FIG. 3

DRY BOWL SMOKER'S PIPE

CROSS REFERENCE TO RELATED APPLICATION

This is a continuation in part of U.S. patent application Ser. No. 331,316 filed Dec. 16, 1981 and issued as Pat. No. 4,577,645 on Mar. 25, 1986; which in turn is a continuation of U.S. patent application Ser. No. 213,725 filed Dec. 5, 1980, now Pat. No. 4,362,169 issued on Dec. 7, 1982.

FIELD OF THE INVENTION

The present invention relates generally to smoker's pipes and more particularly to a new and improved smoker's pipe of the dry bowl type in which the improvement relates to the cooling air flow and to the smoke air path.

BACKGROUND OF THE INVENTION

Conventional pipes, including filtered pipes, and those equipped with metal fittings which form condensation and taint flavor, function today the same way they have for centuries. A single channel, closed at the heel end, connects the bowl, shank, stem and bit. Liquids generated while smoking run-down the single channel and build-up in the heel of the bowl. Filters and other fittings in the smoke channel slow or modify the moisture build-up, but eventually the liquids will enter the bowl and will be absorbed by the tobacco. This condition generally continues until about one-fourth of the tobacco in the lower bowl become saturated with collected liquids.

When the burning tobacco in the upper part of the bowl reaches a saturated tobacco in the lower part of the bowl, combustion is gradually reduced as the degree of wetness is increased. The condition essentially becomes akin to that of trying to burn wet leaves. From the moisture level of the tobacco downwards, the flavor supporting carbon cake build-up on the inner walls of the pipe begins to disintegrate and disappear. Moreover, the heat of descending combustion above this level progressively increases the temperature of the confining liquids, causing excessive heat and accelerating the absorption of contaminants.

These circumstances sustain the development of foul odors and bad taste. In addition, the smoke must pass through this collection of hot, acrid condensate producing a biting sensation on the smoker's tongue.

In my U.S. Pat. Nos. 3,028,867 and 3,422,821, dry bowl pipes are disclosed wherein the outer bowl, shank and stem are moulded of a plastic material and wherein and absorbant cartridge is utilized to absorb the liquid combustion products.

In the magazine "Plastics Design Form", published November/December 1977, a third version of an improved dry bowl pipe is disclosed. This version includes a dual fluid path system with an upper smoke path and a lower moisture path.

Pipes formed in accordance with my aforesaid patents, the parent patents to this application, and the disclosure in plastics design forms function extremely well to provide a smooth, cool smoke without the foul taste attendant to the operation of conventional smoker's pipe. However, the appearance of those pipes is unconventional and does not permit twisting of the stem bit, which is turn could cause damage to the models built in accordance with my prior patents.

SUMMARY OF THE INVENTION

The two parent applications, Ser. Nos. 213,725 filed Dec. 5, 1980 and 331,316 filed Dec. 16, 1981 are incorporated herein by reference, including both essential and non-essential subject matter. However, for the purpose of completeness, some of the disclosure and drawings in those patents will be reproduced here.

As stated in the parent applications, it is an object of the disclosed invention to provide a dry bowl pipe which possesses all of the advantages of pipes of my earlier patents while being less costly to fabricate on a mass production basis and providing a smooth, cool smoke. It is still an object of the present invention to have a dry bowl pipe in which the smoke from the burning tobacco is mixed with a metered fresh air flow and in which the smoke path is divided from the liquid path so as to greatly reduce the moisture contents of the smoke exiting the stem bit.

The present invention has a further object in the construction of a smoker's pipe in which the pipe has the appearance of a conventional smoker's pipe with a round shank and a bit that can be twisted in the shank. At the same time, the object of the present invention is to utilize a dry bowl smoker's pipe in which the smoke and liquid components are still kept entirely separate throughout the entire pipe assembly.

The present invention has yet another object in maintaining the tobacco charge completely dry from the top to the bottom of the bowl so as to maintain uniform quality of the smoke and uniform combustion, enhancing carbon-cake build-up over the entire inner bowl wall.

The present invention exhibits numerous advantages over conventional dry bowl pipes of the prior art. Significant among these advantages are the development of a smooth, uniform and cool smoke; the addition of cooling air to the hot smoke through a hidden passageway; the separation of an air cooling chamber of inner and outer bowls so as to maintain the outer surface of the pipe cooled to the touch; and the development of a dry bowl pipe which may be economically produced using mass production techniques.

Other objects and advantages of the present invention are described in or will become apparent from the following detailed description of the preferred embodiments when taken in conjunction with the accompanying drawings.

BRIEF DESCRIPTION OF THE DRAWINGS

FIG. 1 is a longitudinal, sectional view of one embodiment of an improved air insulated dry bowl pipe according to the present invention;

FIG. 2 is a transverse sectional view taken along the lines 2—2 of FIG. 1;

FIG. 3 is a longitudinal sectional view of a further embodiments of the present invention;

DESCRIPTION OF THE PREFERRED EMBODIMENT

Figure 4:
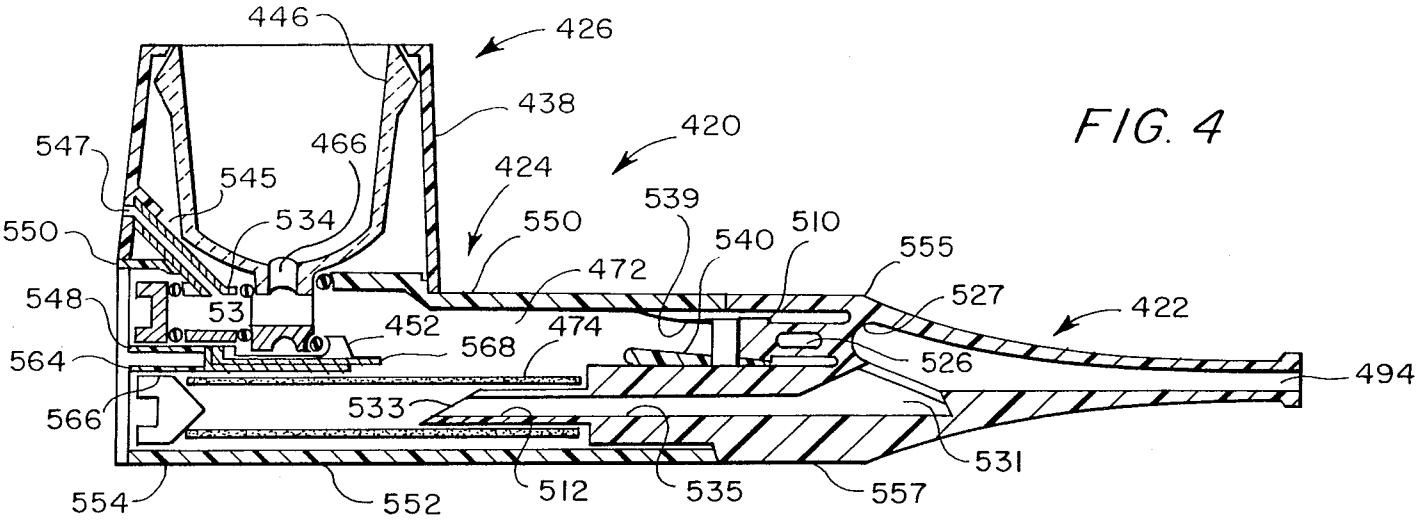
FIG. 4 is a longitudinal sectional view of a pipe in accordance with a further embodiment of the present invention.
Figure 5:
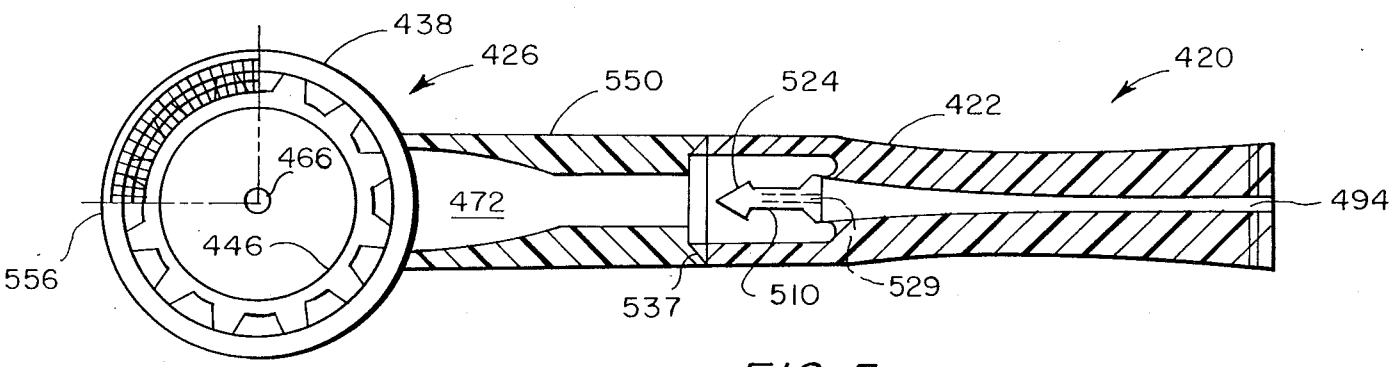
FIG. 5 is a top plan view of the pipe of FIG. 4, taken partly in cross-section.
Figure 6:
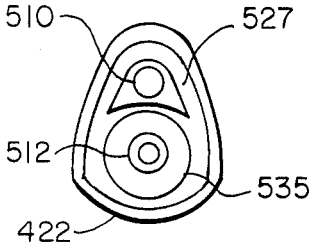
FIG. 6 is an end elevational view of the front end portion of the bit of the pipe depicted in FIG. 4.

Referring now to the drawings in which like numerals referred to like elements in the several views, and initially to FIGS. 1 and 2, there is a shown smoker's pipe 20 having a mouthpiece 22 which is removably attached to a stem 24 provided with a bowl assembly 26. The bowl assembly 26 includes a generally cylindrical, hollow base ring 28 on which is mounted an annular collar 30 having a plurality of air passage openings 32. Collar 30 has an upper end that is inwardly offset so as to form a shoulder 34 and has exterior threads 36.

A generally cylindrical outer bowl 38 is provided with interior threads 40 for cooperation with threads 36 of the collar 30. For esthetic reasons, bowl 38 could also have a conical shape. An outwardly directed flange or lip 42 at the upper end of the outer bowl 38 receivingly mounts a protective metal ring 43.

A ceramic inner bowl 46 is mounted inside base ring 26 spaced concentrically from outer bowl 38. An annular metal screen 47 extends between outer bowl 38 and inner bowl 46 and prevents tobacco and other foreign objects from falling therein and lodging therebetween. Screen 47 also serves as a heat shield to convey heat away from the top of inner bowl 46. Preferably, screen 47 is retained inside outer bowl 38, abutting the lower end of metal ring 43, by being force fitted therein.

Inner bowl 46 contains a plurality of cooling fins 48 which extend downwardly from the main portion of the inner bowl 46 and define a central notch or cut-out 50 for receiving a generally rectangular support shank 52 extending longitudinally within the stem 24. The side walls of shank 52 are curved inwardly at the mid portion thereof forming two pairs of integral supports which receive corresponding ends of the bottom of inner bowl 46.

The generally cylindrical, hollow base ring 28 extends around support shank 52 in the area where the inner bowl is seated. Base ring 28 crosses the longitudinal center line of the pipe at a front wall 56 and a rear wall 58. Rear wall 58 is provided with a circular opening 60 through which a protruding nipple 62 of the inner bowl 46 extends. Coaxial with nipple 62 is a smoke passageway or bore 64 which extends longitudinally and horizontally across the bottom of and completely through inner bowl 46 in the area of the cooling fins 48 and terminates in an enlarged front opening 65 in inner bowl 46. Midway in the passageway 64 and communicating therewith is a downwardly extending vertical passageway 66 which communicates with the interior of inner bowl 46 as shown. As can be seen in FIG. 1, the bottom of inner bowl 46 has slightly sloped sides 68 symmetrically converging on the centrally located vertical passageway 66, which serves to direct the advancing combustion toward the passageway 66 and to provide even burning.

A washer or O-ring 70 is disposed around nipple 62 between rear wall 58 and the outer side surface of inner bowl 46. Nipple 62 protrudes slightly beyond the inner side of rear wall 58 so as to carry the exiting smoke well into an enlarged cooling chamber 72 in stem 24 without having the smoke pass through any intermediate members or come into contact with any other portions of the assembly.

The bottom of base ring 28 terminates above the level of the bottom of shank 52 which preferably has a flat bottom wall 73 such that open air flow passages are established from the bottom to the top of bowl assembly 26 between the outer and inner bowls 38 and 46 thereof.

The pipe 20 according to the present invention includes an assembly for preventing liquids, such as those that condense from the smoke or come from the mouth of the smoker, from gaining access to the inner bowl 46 or the tobacco therein so that the inner bowl remains relatively dry whereby the tobacco burns freely and substantially evenly and completely. This assembly includes an elongated, hollow, flexible absorbent tube 74 formed from convolutions of paper, like a conventional drinking straw, which may be provided with minute perforations through the wall thereof if desired. A wrapping of suitable thermoplastic material 76, such as polythylene, surrounds the tube like a matrix section surrounding a core section. One end of absorbent tube 74 is mounted on a plug 78 that comprises an enlarged head 79 with a terminal flange 80 and a smaller, cylindrical body 82 having an outer diameter sized to be frictionally received inside absorbent tube 74. The distal end 83 of plug body 82 is tapered to permit easier insertion into absorbent tube 74 and a plurality of integral lugs 84 extend longitudinally from head 78 along body 82 a short distance. Slots 86 are thereby provided between lugs 84 for preventing pressure build-up within the interior of tube 74 and permitting liquids to travel around the end and be absorbed by the inner end layers of absorbent tube 74.

Support shank 52 of pipe stem 24 is formed with a bore 88 within which plug 78 and absorbent tube 74 are mounted. The outer diameter of absorbent tube 74 is somewhat less than the diameter of bore 88 so that absorbent tube 74 is freely admitted therein, and the diameter of plug head 79 is sized and tapered to frictionally fit within bore 88 to maintain plug 78 and attached absorbent tube 74 in place. Plug flange 80 overlies the front end of bore 88 and is provided so as to enable plug 78 to be easily inserted into and removed from bore 88. In addition, flange 80 and tapered plug provide an airtight head seal at the front end of bore 88.

As can be appreciated from FIG. 2, stem 24 is oval or tear-drop shaped as is the coupling end 92 of mouthpiece 22. The coupling end 92 has an outer dimension matched with the inner dimension of stem 24 such that the mouthpiece may be frictionally slid into place or removed for cleaning. Mouthpiece 22 has a longitudinal bore 94 therein which extends from the bit end 96 into a second phase cooling chamber 98. Chamber 98 is formed by a bore having a first rear wall 100 from the end of bore 94 to the bottom 102 thereof. A second, circular, rear wall 104 is formed above bore 88 and is separated therefrom by a partition 106.

Disposed within the end of mouthpiece 22 adjacent chamber 98 is a removable cluster assembly 108 containing a smoke passage tube 110 and a liquid tube 112. Liquid tube 112 extends toward the front or bowl end of pipe 20 and has an inclined end 114 that is adapted to be received within the outer end of absorbent tube 74. The other end of liquid tube 112 opens onto a compartment 116 which communicates with chamber 98 and bottom 102. Bottom 102 is preferably inclined downwardly from mouthpiece 22 towards cluster assembly 108 so that any liquids that collect tend to drain down toward the inclined end 114 of liquid tube 112 where they are absorbed by absorbent tube 74. First rear wall 100 meets bore 94 at a relatively sharp lip 118 which has the effect of preventing any liquids from running back up bore 94 to bit end 96.

Smoke passage tube 110 extends approximately equally on both sides of cluster 108 having an upstream portion 119 disposed within first phase cooling chamber 72 and downstream portion 121 disposed within second phase cooling chamber 98 adjacent second rear wall 104. A depending boss 120 is formed along part of the bottom of downstream portion 121 of tube 110 and partition 106 is birfurcated by a slot 122 which together provide a passageway through which the smoke may pass is constrained to travese an S-shaped flowpath which develops some turbulence and quite effectively promotes cooling and moisture separation.

An end closure or plug 124 is located in the forward end of smoke tube 110 and is provided with two aligned side orifices 126. A transverse bottom slot 128 extends upward into the bottom of orifices 126 and connects them to provide one flow. The length of partition 106 can be substantially reduced or removed to prevent excessive moisture accumulation. Coaxially aligned with front opening 65 when inner bowl 46 is mounted in bowl assembly 26 is a threaded orifice 132 in base ring front wall 56 that is also located directly above bore opening 88. Orifice 132 receives an externally threaded barrel screw 134 having a threaded bore 136 therethrough. The forward end of barrel screw is provided with a slot (not shown) so it can be screwed into orifice 132. The rearward end of barrel screw sealingly engages an O-ring 138 mounted in inner bowl front opening 65. An externally threaded jet plug 140 mates with and is received by threaded bore 136 of barrel screw 134. Jet plug 140 has in internal T-shaped bore 142 therein, the transverse section of bore 142 being located in the rearward portion thereof and the forward portion being in communication with the air outside pipe 20. The terminal end surface 144 of plug 140 has a concave shape. By its construction, jet plug 140 breaks up the incoming fresh air and causes it to be sprayed into horizotal passageway opening 65.

Inner bowl 46 is rigidly attached inside outer bowl 38 solely by barrel screw 134 forcing the rearward side of bowl 38 into a retaining engagement with rear wall 58 of base ring 28.

In the present invention, there is a relatively large chamber 72 in the smoke passage. Chamber 72 does not cause any drawing problems if the ratio of the diameters of passageway 64 (about 0.280 inches) and bore 94 (about 0.125 inches) is between about 1.8 to about 2.5 with a presently preferred ratio being about 2.25. The function of the draw degrades significantly the closer the two diameters approach each other in size. An ideal diameter of vertical passageway 66 was experimentally found to be 0.125 inches. This is the same size as bit bore 94. An optimum size for chamber 72 was experimentally found to have a height of 0.725 inches and a cross-section of 0.500 inches.

The diameter of bore 142 is also critical—too large a bore and the smoke will be too clean and too small a bore and the smoke will have insufficient cooling. Through experimentation, it was found that a bore 142 having a diameter from about 0.020 inches to about 0.050 inches, with a presently preferred range of 0.030 to 0.36 inches, works best with bore of 0.036 and a vertical bore 66 of 0.140, the air is about 25% of the mixture. Proper calibration of the length and diameter of the various smoke passages is necessary to reduce condensation outside chamber 98 and compartment 116. To minimize condensation accumulation, horizontal passageway 64 has a slight rearward and downward slope to take advantage of gravity to carry the condensation to chamber 72. A 7 degree down angle has been found to be satisfactory. Also, a countersunk rearward opening can be provided in place of nipple 62, thereby shortening passageway 64.

Referring now to FIG. 3, an improved version of pipe 20 is depicted. This improved version is denoted to 220 and subsequent numbers which refer to elements that are similar to elements in pipe 20 will have a numerical designation that is 200 greater than the numerical designation of the elements in pipe 20. Pipe 200 provides a more attractive appearance and a lighter weight than pipe 20.

Pipe 220 comprises a chassis 221, a mouthpiece 222 removably attached to the rearward end of chassis 221 and a bowl assembly 226 attached to the forward, upper end of chassis 221. Chassis 221 includes a rearward stem 224 and a forwardly located bowl mounting assembly 225. Bowl assembly 226 includes a truncated, conical outer bowl 238 having a circumferential, inner flange 239 at the upward end thereof. Outer bowl 238 is further provided with a longitudinal notch defined by two lower skirts 243 and snap-on fastening means for frictional engagement with cooperating means (not shown) on the outside of mounting assembly 225. Bowl assembly 226 also includes a porcelain inner bowl 246 rigidly mounted between outer bowl flange 239 and mounting assembly 225. The top of outer bowl 236 projects above the top of outer bowl 238 so as to provide a heat and fire shield for outer bowl 238. Inner bowl 246 is provided with two coolings fins 248 located at a bottom thereof and a plurality of spaced apart cooling flanges 249 mounted around the upper periphery thereof. Cooling flanges 249 have a generally triangular shape in cross-section so as to provide both a cooling function and to provide an upper inclined surface for centering engagement with outer bowl flange 239. A reflective coating 251 is provided on the inner surface of outer bowl 238 so as to promote a vertical flow of cooling air between inner bowl 246 and outer bowl 238.

Inner bowl 246 is mounted on mounting assembly 225 of chassis 221 with a rearwardly protruding nipple 262 and a fowardly protruding nipple 263 at respective ends thereof. A rearward O-ring 270 and a forward O-ring 271 provide fluid sealing engagement between nipples 262 and 263 and mounting assembly rear wall 258 and barrel screw 334, respectively. In addition, mounting assembly 225 is provided with longitudinally spaced apart supports 254 which receive the bottom of cooling fins 248.

Longitudinal passageway 264 is extremely short, having a length of only about 5/16 of an inch. A typical diameter is 0.156 inches (⅜ of an inch). Vertical passageway 266 has a length of 3/16 of an inch and a diameter of 0.140 inches (9/64 of an inch). Therefore, the effective ratio of vertical passageway 266 with the operative length of the horizontal passageway 264 (from vertical passageway 266 to the end of nipple 262) is about one-to-one.

Pipe 220 is also provided with an absorbent tube 274 mounted at its forward end on a modified plug 278. Plug 278 is threaded so as to be receivable in a correspondingly threaded orifice in stem 224 and has a hexagonal hole 279 for receiving a hex wrench. The other end of absorbent tube 274 is mounted on liquid passage tube 312 of a similar cluster assembly 308.

Mouthpiece 222 has a longitudinal bore 294 extending from a bit end 296 into a second phase cooling chamber 298. Chamber 298 is formed by an enlarged bore in the forward end of the mouthpiece 222, has an arcuate upper wall 304, and is provided with a lip 318 along the lower wall.

Disposed within the end of mouthpiece 222 into chamber 298 is a removable cluster assembly tube 308 comprised of a smoke tube 310 and a liquid passageway tube 312. Smoke tube 310 extends forwardly and terminates in a vertically crimped, angled end 324. Two ovular side orifices 326 (only one of which is shown) are provided in the sides of smoke tube 310. Orifices 326 are not connected at the bottom; as in smoke tube 124 in FIG. 3., thereby requiring the smoke to divide into two flow paths. Pipe 220 is also provided with an inclined stack screw 345 having an internal bore 347 which also locks barrel screw 334 into position. Through a corresponding opening 353 in outer bowl 238, fresh air can enter stack screw 345 and travel into threaded bore 336 of barrel screw 334. Jet plug 340 is provided with a circular recess 343 and internal bore 342 communication with recess 343. Jet plug 340 is also provided with an hexagonal hole 341 of the same size as hole 279 in plug 278. A fluid tight seal between jet plug 340 and barrel screw 334 is provided by an O-ring 351.

Referring now to FIGS. 4–8, a smoker's pipe 420 is depicted according to a third embodiment of the present invention. Like pipes 20 in FIG. 1 and 220 in FIG. 3, pipe 420 is comprised of a mouthpiece 422 connected to a stem 424. Mounted on the forward end of stem 424 is a bowl assembly 426. Bowl assembly 426 is substantially similar to bowl assembly 226 and will only be described in detail with respect to the different mounting structure as depicted in FIG. 4. Bowl assembly 426 is comprised of a plastic outer bowl 438 and a ceramic inner bowl 446 having a vertical smoke hole 466.

Bowl assembly 426 is mounted in the forward part of stem 424 with a barrel screw 534 threaded into an opening 532 in stem 424. A stack screw 545 brings fresh air through an orifice 547 into the interior of barrel screw 534. When installed, the lower portion of inner bowl 438 is supported by a support shank 452. The forward end of support shank 452 has a bore 548 therein which extends outwardly through the outer surface of stem 424 and which has an enlarged forward bore portion. As seen in FIG. 4, stem 424 and mouthpiece 422 respectively have a top wall 550 and 555, and a bottom wall 552. Located between the bottom of support shank 452 and the top of stem bottom wall 552 is an absorbant tube 474 that has a positioning plug 478 in the front end thereof.

Stem 424 also has a rounded front end 554 and outer bowl 438 has a similar rounded front end 556 that generally conforms to the shape of stem front end 554. A generally rounded triangular recess 558 is provided in bowl front end 552 that is continued in a recess 560 in stem front end 554. A cover 564 having the same configuration as combined recesses 558 and 560 is mounted to stem front end 554 by an elongate mounting member 566 that extends perpendicularly from cover 564 and is received by bore 548. A push rod 568 extends through the smaller rearward portion of bore 548 and continues into a plenum or forward cooling chamber 472 of stem 224. When installed, cover 564 hides the forward end of barrel screw 534 and the forward end of plug 478. When access to the forward end of chamber 472 is desired, mouthpiece 422 can be removed from stem 424 and push rod 568 pushed in the forward direction. The movement of push rod 568 in the forward direction in turn causes the movement of cover 564 in the same direction, thereby exposing the sides thereof for grasping and removal.

As depicted in FIGS. 4 through 7, mouthpiece 222 has a bore 494 completely therethrough and a fluid separation means located in the forward end of mouthpiece 422 for dividing the moisture ladden smoke into a moisture removed gaseous stream and a liquid stream. The fluid separation means is comprised of a cylindrical smoke passage tube 510 integral with mouthpiece top wall 555 and a liquid passage tube 512 integral with mouthpiece bottom wall 557. Smoke passage tube 510 has a pointed or angled forward end 524 and two side orifices 526 (only one of which is shown). A flange 527 in the forward upper portion of mouthpiece 422 divides mouthpiece into a smoke path and a liquid path. Smoke tube 510 has a bore 529 therein in communication between side orifices 526 and the rearward end of smoke tube 510. Liquid collecting around smoke tube 510 enters through orifices (not shown) in the sides and top of liquid tube 512 and collect in absorbant tube 474. In addition liquids collected rearwardly of flange 527 enter liquid tube 512 through a plenum 531.

Liquid tube 512 includes a forward pointed portion 533 for insertion into absorbant tube 474 and an integral tenon or mid-portion 535 that extends beyond a sealing chamfer 537 of mouthpiece 422.

Figure 7:
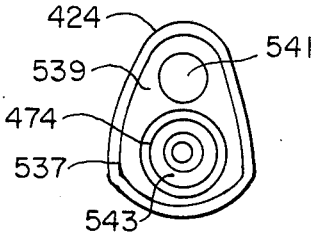
FIG. 7 is a front elevational view of the shank portion only of the pipe depicted in FIG. 4.

As particularly seen in FIG. 7, stem 424 also includes a flange 539 having a smoke orifice 541 and a liquid orifice 543. In addition, the rearward end of stem 424 has a sealing chamfer 544 for sealingly engaging mouthpiece chamfer 537. Flange 539 also includes a forwardly extending sleeve 540 which rotatably mounts tenon 535 of mouthpiece 422 to stem 424. However, there is no extended portions in the upper portion of mouthpiece 422 or the upper portion of stem 424, and thus mouthpiece 422 is free to rotate about stem 424. Such rotation is not possible in pipes 20 and 220 of FIGS. 1 and 3, respectively because of the non-circular circumference of the stem and mouthpiece engaging portions. Nevertheless, the somewhat oblong cross sections of the stem and mouthpiece can still retained so that the overall diameter of these elements can be kept to a minimum, on the one hand, while still permitting the over-and-under configuration of the smoke and liquid tubes.

Figure 8:
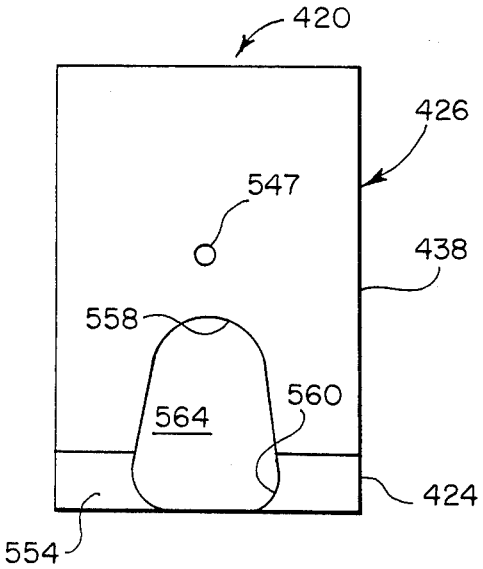
FIG. 8 is a longitudinal sectional view of the shank and bowl portion of yet another embodiment of the present invention.
Figure 9A:
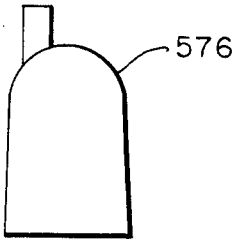
FIG. 9 is a front elevational view of a first embodiment of an insert cap installable on the front bowl end of the pipe depicted in FIG. 4.
Figure 9B:
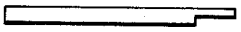
Figure 10A:
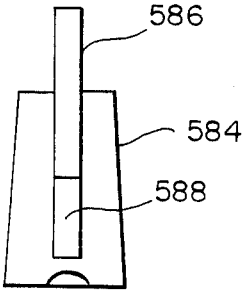
FIGS. 10*a* and 10*b* are, respectively, a rear elevational view and a side elevational view of a second embodiment of cap.
Figure 10B:
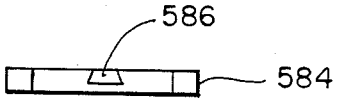

FIGS. 9 and 10 depict two variations of cover 564 of FIG. 8. In FIG. 9*a*, a generally rounded top trapezoidal cover 576 is depicted. Cover 576 includes a main portion 578 and a recessed, off-center, upwardly extending blade portion 580 having a reduced cross section, as shown in FIG. 9*b*. Blade portion 580 is offset from the center line of main portion 578 so as not to interfer with stack screw 545, and is recessed so as to fit into a corresponding channel (not shown) in outer bowl 438. In this way, mounting member 566 of cover 564 can be eliminated. In addition, blade portion 580 can be used as a tobacco reamer.

In FIG. 10*a* a trapezoidal cover 582 is depicted. Cover 582 includes a main portion 584 and a centrally located, slidable blade member 586 having a dove-tail cross section located in a correspondingly shaped groove 588 in main portion 584. A notch 585 in the bottom of portion 584 permits a hidden means for engaging cover 582 to remove it.

Figure 11:
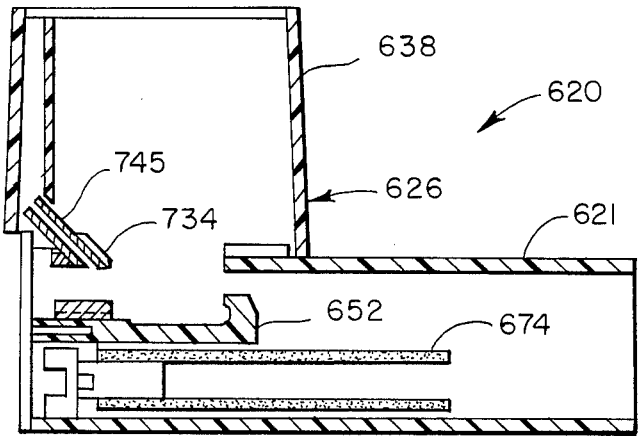
FIGS. 11*a* and 11*b* are, respectively, a rear elevational view and a side elevational view of a third embodiment of an insert cap.

A modified smoker's pipe 620 is depicted in FIG. 11. In this figure, only a stem 624 and a bowl assembly 626 are shown. Bowl assembly 626 comprises an outer bowl 638 and an inner bowl (not shown, but substantually similar to inner bowl 446 of FIG. 4). Outer bowl 638 has a ventilation tube 639 integral with the inner wall of bowl 638, open at the upper end and in fluid communication with a bore in a hollow barrel screw 744 through a hollow stack screw 745. In this way, pipe 620 can provide fresh air to pipe 620 without having the appearance of outer bowl 638 marred by the appearance of a fresh air orifice, such as orifice 547 in FIG. 8.

Figure 12:
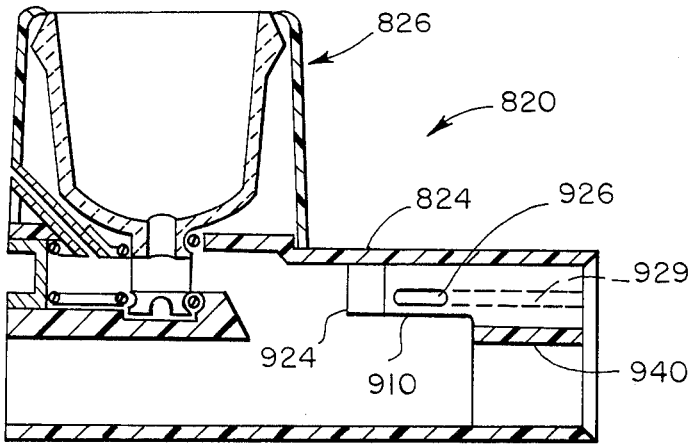
FIG. 12 is a longitudinal sectional view of the bowl and shank of still a further embodiment of the present invention.
Figure 13:
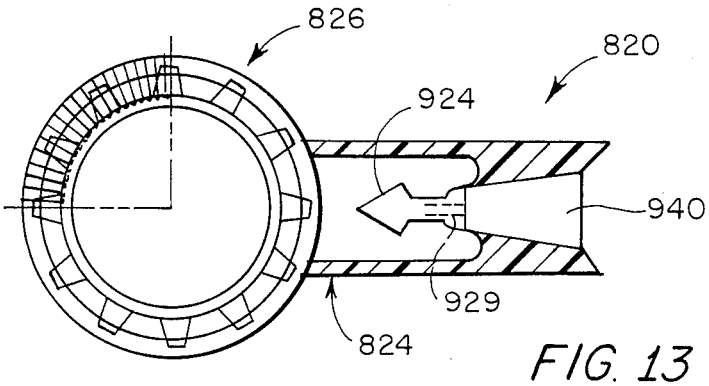
FIG. 13 is a top plan view, partly in cross-section of the bowl and shank portion of the embodiment depicted in FIG. 12.

Finally, with reference to FIGS. 12 and 13, a further embodiment of a pipe 820 according to the present invention is depicted. Actually, only a stem 824 and a bowl assembly 826 are depicted. Pipe 820 is substantally similar to pipe 420 of FIG. 4, except that the fluid separation means, comprised of smoke flow tube 910 is integrally located in stem 824 instead of the mouthpiece. Tube 910 has a pointed forward end 924, side orifices 926 and an internal bore 929. In addition, pipe 820 includes a forwardly extending sleeve 940 which rotatably mounts a tenon of the mouthpiece (both not shown, but similar to that depicted in FIG. 4, except for the obvious differences with respect to smoke tube 510) to stem 424.

From the foregoing, it can be appreciated that the present invention provides many distinct advantages and will result in a cool, flavorful smoke from beginning to end without the distasteful bite, foul taste, or unpleasant odors experienced in the past.

Inasmuch as the present invention is subject to many variations, modifications and changes in detail, it is intended that the foregoing description be interpreted as illustrative and not in a limiting sense.

I claim:

1. A smoker's pipe comprising an elongate hollow shank having a forward and a rearward end;

a bowl assembly connected to said forward end of said shank and in fluid communication therewith;

an elongate bit having a bore therethrough and removably connected to said rearwad end of said shank in longitudinal alignment and in fluid communication therewith, the bowl assembly, shank and bit defining a fluid path through said pipe;

flow separation means in said pipe for dividing said fluid path into a gaseous smoke path and a liquid path, said separation means comprising a smoke conduit which forms part of said smoke path and a liquid conduit which forms part of said liquid path, said liquid and smoke conduits having shank portions located in said shank and having bit portions located in said bit; and means for rotatably connecting said bit to said rearward end of said shank, said connecting means including first means for sealingly connecting said smoke conduit bit and shank portions together and second means for sealingly connecting said liquid conduit bit and shank portions together.

2. A smoker's pipe as claimed in claim 1 wherein said separation means is rigidly connected to said bit and is located inside said bit bore.

3. A smoker's pipe as claimed in claim 2 wherein said separation means further includes a pointed member having a solid pointed head and a hollow shaft portion integral with said head and in fluid communication with said bit bore, said shaft portion including orifices so that said shaft portion is also in fluid communication with said shaft hollow portion when said bit is mounted in said shaft.

4. A smoker's pipe as claimed in claim 3 wherein said liquid conduit includes a liquid cylindrical tube rigidly mounted to said bit and wherein said liquid tube extends forwardly of said bit into said shaft when said bit is mounted on said shaft; and wherein said shaft includes a hollow sleeve portion integral with said shank and has a cylindrical inner surface with a diameter slightly larger than the outer diameter of said liquid tube so that said shank is rotatably and sealingly connectable to said bit.

5. A smoker's pipe as claimed in claim 1 wherein said separation means is rigidly connected inside said shaft.

6. A smoker's pipe as claimed in claim 5 wherein said separation means further includes a pointed member having a solid pointed head and a hollow shaft portion integral with said head and in fluid communication with said bit bore, said shaft portion including orifices so that said shaft portion is also in fluid communication with said shaft hollow portion when said bit is mounted in said shaft.

7. A smoker's pipe as claimed in claim 6 wherein said liquid conduit includes a liquid cylindrical tube rigidly mounted to said bit and wherein said liquid tube extends forwardly of said bit into said shaft when said bit is mounted on said shaft; and wherein said shaft includes a hollow sleeve portion integral with said shank and has a cylindrical inner surface with a diameter slightly larger than the outer diameter of said liquid tube so that said shank is rotatably and sealingly connectable to said bit.

8. A smoker's pipe as claimed in claim 1 wherein said liquid conduit includes a liquid cylindrical tube rigidly mounted to said bit and wherein said liquid tube extends forwardly of said bit into said shaft when said bit is mounted on said shaft; and wherein said shaft includes a hollow sleeve portion integral with said shank and has cylindrical inner surface with a diameter slightly larger than the outer diameter of said liquid tube so that said shank is rotatably and sealingly connectable to said bit.

9. a smoker's pipe comprising an elongate hollow shank having a forward end and a rearward end;

a bowl assembly connected to said forward end of said shank and in fluid communication therewith, said bowl assembly including an outer bowl and an inner bowl mounted on said shank, said outer bowl having an access opening located in the front part of said outer bowl;

an elongate bit having a bore therethrough and connected to said rearward end of said shank in longitudinal alignment and in fluid communication therewith, the bowl assembly, shank and bit defining a fluid path through said pipe;

flow separation means in said pipe for dividing said fluid path into a gaseous smoke path and a liquid path;

means for collecting liquid in said liquid path, said access opening providing access to said collecting means; and means for hiding said access opening and for providing a smooth appearance to the front part of said bowl assembly, said hiding means comprising a curved shield member that has a circumferential shape which corresponds to the circumferential shape of said access opening, and means for removably mounting said shield member rigidly place on said bowl assembly.

10. A smoker's pipe as claimed in claim 9 wherein said shield member mounting means comprises an elongate handle portion integral with said shield and an elongate groove located in the inner side of said outer bowl, said groove receiving said handle portion.

* * * * *